US005241787A

United States Patent [19]

Norman

[11] Patent Number: 5,241,787

[45] Date of Patent: Sep. 7, 1993

[54] CELL DOOR OPERATING SYSTEM

[75] Inventor: Richard O. Norman, San Antonio, Tex.

[73] Assignee: Adtec, Incorporated, San Antonio, Tex.

[21] Appl. No.: 818,801

[22] Filed: Jan. 9, 1992

Related U.S. Application Data

[63] Continuation-in-part of Ser. No. 728,697, Jul. 11, 1991, Pat. No. 5,212,908.

[51] Int. Cl.[5] ..... E05B 47/06

[52] U.S. Cl. ..... 49/16; 49/18; 49/449

[58] Field of Search ..... 49/18, 449, 16, 15, 49/20

[56] References Cited

U.S. PATENT DOCUMENTS

| | | | |
|---|---|---|---|
| 3,009,545 | 11/1961 | Young | 49/16 X |
| 3,866,354 | 2/1975 | Butt | 49/16 |
| 4,190,985 | 3/1980 | Richards et al. | 49/16 |
| 4,621,451 | 11/1986 | Bruehler | 49/18 X |
| 4,723,373 | 2/1988 | Jump | 49/18 |
| 4,897,959 | 2/1990 | Worden | 49/18 |
| 4,912,878 | 4/1990 | Bentley | 49/449 X |

*Primary Examiner*—Philip C. Kannan
*Attorney, Agent, or Firm*—Gunn, Lee & Miller

[57] ABSTRACT

A symmetrical cell door and operating system comprises a vertically shiftable locking bar mounted in a center column of a cell opening. A cell door is movable in either direction relative to the central column and has upwardly facing locking notches in a lower horizontal frame element to receive the lower end of the locking bar to lock the cell door when moved either to the extreme right or to the extreme left of the center column. An elongated rack is secured to the top of the cell door by a lost motion connection and defines a cam slot engagable with a horizontally projecting actuator on the locking rod to cam the locking bar into and out of the respective locking notch. The rack is reciprocated by a pinion driven by a DC motor. Two separate banks of batteries selectively supply power to the DC motor and one bank is always being charged, thus eliminating the need for a mechanical backup system for concurrently opening or closing all cell doors in the event of a failure of the AC power supply to the building. In a modified system, the symmetrical door is electrically locked and unlocked by a DC motor, but manually moved between locked and unlocked positions.

7 Claims, 10 Drawing Sheets

CELL DOOR OPERATING SYSTEM

RELATIONSHIP TO PENDING APPLICATION

This application constitutes a continuation-in-part of pending application, Ser. No. 728,697, Filed Jul. 11, 1991, now U.S. Pat. No. 5,212,908, issued May 25, 1993.

BACKGROUND OF THE INVENTION

1. Field of the Invention

The invention relates to an operating and locking system for jail cell doors, including both a novel apparatus and method of operating same.

2. Summary of the Prior Art

For the past thirty years, the construction and operation of slidable type doors for jail cells has not been significantly changed. Each cell door is moved from a closed, locked position to an open position by an elongated rack element linearly movably mounted in a steel housing assembly constituting a top frame for the cell door and providing a horizontal track for rollers supporting the cell door. Such rack is driven by a pinion which in turn is rotated by a reversible AC motor. A lost motion connection is provided between the rack and the cell door. Normally, utility supplied 110 volt AC power is utilized to energize the motor.

For maximum security installations, the locking of the cell door is usually accomplished by a vertically downward shifting of a steel locking rod which extends downwardly on a central column in the door opening of the cell to engage a locking notch provided in a horizontal steel element forming the bottom portion of the cell door. The locking rod is shifted vertically from its locked to unlocked positions by a cam surface provided in depending relationship to the rack which is engagable with a radially projecting pin carried by the top end of the locking rod. When desired, a secondary locking element may be provided in the opposite side of the door adjacent the top of the door. The secondary locking element is likewise vertically shifted between locked and unlocked positions by a cam mounted in depending relationship to the rack and engagable with a pin projecting radially from the locking rod. The secondary locking element cooperates with a notch or hole formed in the steel frame assembly which extends across the entire width of the cell and provides a housing for the roller track, the rack, the motor driven pinion and a mechanical backup unlocking mechanism to be described. The lost motion connection between the rack and the cell door permits initial movement of the rack to release the locking element and rod before an opening force is applied to the cell door.

The employment of utility supplied AC power as the driving energy for cell door locking and opening mechanisms is subject to several well known disadvantages. In the first place, penitentiaries are generally located in rural areas, and the utility service, if interrupted, generally requires a substantial period of time before service can be restored. If expensive diesel powered backup generators are provided, valuable time is wasted in starting the diesel engine and bringing the generator up to operational speed. Even more importantly, by utilizing AC electric motors to move the cell door from an open to a closed position, thermal cut-off of such motors is often produced by the cell occupants placing obstructions between the vertical edge of the cell door and the frame against which the door abuts in its closed position to prevent the door from reaching its closed position. Under such circumstances, the stalled 110 volt AC motor heats up in a fairly short time and a thermal overload switch conventionally incorporated within the housing of such motor opens. While this protect the motor from damage, it inherently involves a delay of at least a half hour for the motor to cool sufficiently to permit the thermal switch to be reset and the motor restored to an operating condition. During this time period, the cell door remains in its partially open position and, of course, can be manually moved or pried to a sufficiently open position to permit the cell occupant to exit from the cell.

To overcome these disadvantages, the prior art cell door operating mechanisms provided two forms of mechanical backup to loss of electrical power. Since it is common to control all of the cell doors in a cell block from a control room located so as to have visibility into all of the cells of a U-shaped cell block, a mechanical door release mechanism was provided comprising a complicated, extensive and expensive linkage which ran through the top portion of all of the cell door operating mechanisms of the cell block, even turning the corners of the U-shaped cell block. Such linkage was supposedly manually operable by a massive lever or a hand wheel mounted in or adjacent to the control room. Thus the total length of this mechanical lock releasing linkage could be on the order of at least 150 ft.. Since linear movement must be imparted to the entire linkage by the lever or hand wheel, the linear rods by which such linear movement is transmitted must be mounted in each cell block in precise alignment with the rods of adjacent cells so that frictional binding of the linkage rods will not occur which would prevent the entire linkage from being shifted by the force manually exertable by the control room guard.

As is well known to those skilled in the art of constructing jails, concrete walls are the preferred and most economical construction, but such walls cannot be accurately fabricated to define precise horizontally aligned, vertical planes, hence brackets secured to the concrete walls for supporting the actuating rods of the prior art mechanical release linkage were seldom aligned. This results in the tedious job of shimming out those portions of the concrete wall which vary horizontally from other portions of the same or other walls, so as to provide horizontally aligned surfaces on which to mount the supporting brackets for the mechanical linkage. This necessity for highly accurate installation of the very lengthy and complex mechanical backup linkage greatly increases the cost of installing a conventional cell door operating system.

Additionally, the mechanical backup linkage is necessarily mounted in a position above the rack provided for the motor operation of each cell door. The common release mechanism operated by the mechanical backup linkage includes a pivoted support frame for the motor driven pinion which drives the rack. Thus the motor driven pinion was first lifted from engagement with the rack. Further movement of the mechanical backup linkage engages the rack structure to move same to release the cell door locking members by the cams carried in depending relationship to the rack. All cell doors can then be manually rolled to their respective open positions.

All of this mechanism must necessarily be mounted above the rack, and the end result is that the total height of the top frame assembly is always 15 inches or more.

Normal penitentiary construction involves only an 8 ft. height between the floor and the ceiling. This necessarily means that cell doors in excess of 6 ft. in height cannot be used, and it would be highly desirable if a 7 ft. cell door could be provided within the 8 ft. floor to ceiling limitation of the most economical building structure.

Still another disadvantage of the continuous linkage of the mechanical backup mechanism is the fact that if it is not used very often or not lubricated, the frictional drag produced by rust or dirt in the multitude of bearing supports will prevent the manual operation of the linkage. Settling of the building will, of course, distort the alignment of the supporting bearings for the mechanical linkage rods and further effect a bindup of the mechanical backup system.

As mentioned above, in addition to the mechanical backup release mechanism for concurrently shifting all cell doors to an open position, the prior art locking mechanism of each cell door could be individually operated by the insertion of a specially designed key through an opening in a front panel covering the U-shaped channel which mounts the motor driven pinion, the rack, the cell door rollers and the mechanical backup linkage. The rotation of such key by an elongated lever handle will disengage the lifting of the motor driven pinion out of engagement with the rack, and move the rack sufficiently to release the cell door locks so that each cell door may be manually opened in the event of failure of the mechanical backup linkage.

Another major deficiency of prior art cell door locking systems is the fact that four separate designs of cell doors had to be provided by manufacturers in order to meet architect requirements for both right hand and left hand opening doors an right hand and left hand locations of the mechanical backup linkage. A symmetric door and operating system which could meet all of the requirements with a single design, was not available.

Lastly, prior art locking systems did not positively lock the cell door in an open position, thereby inviting abuse of the gear drive for the rack engaging pinion.

There are many jails and hospital wards that do not require the maximum security door locking systems heretofore described. To reduce costs, locking systems for such institutions incorporate AC motor driven locking and unlocking systems, but do not provide for motor driven opening and closing of the doors. Instead the doors, once unlocked, are manually shifted to either their closed, locked positions or their open positions.

The same problems are encountered in the reduced security systems as described above. The constant risk of failure of utility supplied AC power requires a mechanical back-up linkage to permit the guard or attendant to unlock all the doors by manual operation of a single lever or wheel located in, or adjacent to the control booth, plus a key controlled, manually operated mechanism for each door for manual unlocking of the doors if the mechanical back-up linkage is jammed. Again, prior art locking systems of this type are very expensive to install, require separate door designs for left hand and right hand opening doors, and require a vertical space above the door of more than 12 inches, thus eliminating the possibility of utilizing seven foot doors in the most common building constructions having an eight foot floor to ceiling clearance. There is a need, therefore, for an improved cell door construction and operating system which will overcome each of the aforesaid disadvantages and which will occupy less vertical space at the top of the cell door opening, permitting the installation of 7 ft. cell doors.

SUMMARY OF THE INVENTION

A maximum security cell door operating system embodying this invention overcomes each of the aforementioned deficiencies of prior art mechanisms and can be manufactured and installed for a substantially lower total cost than prior art systems. The cell door is conventionally hung by rollers riding on a horizontal track provided below the top surface of the door opening. The cell door has an operating mechanism having a total height of less than 12 inches. No mechanical backup linkage is required to effect the unlocking and opening of some or all doors in the event of interruption of the AC power supplied to the prison complex from whatever source. The motors for driving the rack engaged pinion are DC motors, preferably supplied with DC power at 24 volts from one of two separate banks of batteries. One bank of batteries is always being charged while the other bank is on line. The two battery banks are preferably placed in different locations so that a fire or flood in one battery bank location will not affect the viability of the other battery bank. Alternatively, a single battery bank with a floating charger could be employed.

In the event that the batteries are concurrently disabled, each individual cell door can be unlocked by inserting a lever key through an opening in the upper frame housing which is normally closed by a bolted cover. Such lever key is engagable with a horizontally pivoted support for the DC motor and its gear driven pinion lift the pinion out of engagement with the rack. The lever key then makes a lost motion connection with the rack to move the rack in the direction to unlock the cell door. Once this is accomplished the cell door may be readily opened manually.

To overcome the problem of doors not closing, or not fully opening, because of obstacles placed between the vertical edge of the cell door and the vertical wall of the door opening, the method of this invention provides circuitry for each DC motor that acts in response to a predetermined increase in DC current drawn by the motor to immediately interrupt the current flow to the DC motor, thus preventing any overheating of such motor. More importantly, the DC energization voltage for the DC motor is then repeatedly applied, at 3 to 5 second intervals, for only a few milliseconds to determine whether the cell door is still blocked from closing. Thus, overheating of the DC motor is prevented, and, as soon as the obstacle is removed, the DC motor is immediately energized to complete the closing, or opening of the cell door.

A important feature of all cell door locking and operating mechanisms embodying this invention is that the total vertical space required above the cell door to house the rack and the DC motor driven pinion is substantially reduced over prior art designs, thus making the installation of a seven ft. high cell door in an eight foot floor to ceiling door opening space completely possible at a substantially lower total cost.

A cell door and its associated operating and locking mechanism embodying this invention is completely symmetrical, permitting the same door to function as either a right hand opening door or a left hand opening door. Moreover, the cell door is as firmly locked in its fully open position as it is in its closed position. This feature obviously eliminates abuse of the door by inmates applying lateral forces to the door when opened which have to be absorbed by the rack teeth engagement with the rack driving pinion.

The symmetrical design of a cell door embodying this invention is accomplished by the mounting of a vertically shiftable locking bar in a center post or column located in the center of the space provided for the movement of the door between an open or a closed position. Thus the cell entryway may be selected to be either on the right hand or left hand side of the center column. A pair of upwardly opening notches are provided in the lateral end portions of a bottom frame element of the cell door to respectively receive the bottom end of the locking bar when the cell door is in either its extreme right hand or its extreme left hand position relative to the center column. Thus, regardless of whether the entryway is to the right or left of the central column, the cell door is locked by the vertical locking bar in both its open and closed positions. The vertical locking bar is raised or lowered by a cam track provided on the rack support. A lost motion connection is provided between the rack support frame and the roller mounting frame of the cell door. Thus, the locking bar is released by the initial movement of the rack in either direction from its locked position.

In similar manner, two upper latches are respectively horizontally pivotally mounted adjacent the two ends of the roller frame mounting member of the cell door and respectively engage in two of three horizontally spaced notches formed in the bottom flange of a top frame element rigidly spanning the cell door opening. The upper latches are engaged to lock the cell door in both its open and closed positions regardless of whether the cell entryway is to the right or left of the center column. The upper latches are shifted into and out of engagement with the respective notches by cam tracks on each end of the rack which are respectively traversed by projections secured to the upper latches. Such latches are locked or released by the initial movement of the rack due to the essential lost motion connection between the rack and cell door. Thus, a single door design will accommodate both left hand or right hand entryways and will hereinafter be referred to as a symmetrical cell door.

A reduced security system embodying this invention effects the unlocking and only the initial movement of the door toward either its closed locked position or its locked open position. The locking functions are performed by a DC motor which is supplied from a battery bank that is always charged. The locking is accomplished by a vertically shiftable locking bar mounted on a central post in the door frame opening and having a bottom end cooperating with one of two locking notches formed in the opposite ends of a guide channel rigidly secured across the bottom portion of the door.

An elongated cam plate is mounted for limited horizontal movement adjacent the roller support plate which mounts the rollers by which the door is hung in the cell door opening. A bolt projects outwardly from the top end of the locking bar and mounts a cam roller which rides in a cam slot formed in the cam plate. The cam plate is shifted laterally relative to the locking bar by a rotary cam driven by a DC motor. A roller bearing is provided on the adjacent edge of the cam plate and a spring biases the cam plate and roller bearing into engagement with the periphery of the rotary cam. The cam motor is selectively operated by a switch on the control panel, or by a key operated switch located adjacent the door frame. Conventional switches on the cam plate permit the selective operation of the rotary cam through 360° or 180°, depending on whether automatic locking of the door in its opened position is desired.

Assuming that automatic locking of the door in its opened position is desired, the 360° rotation switch is connected in the motor circuit. The cam motor is then energized and the rotary cam rotates through 180° to shift the cam plate laterally to effect the raising of the vertical locking bar and the unlocking of the door. Another spring, which is compressed by the initial movement of the door to its locked position, then moves the unlocked door a few inches toward its open position. The remainder of the opening movement is accomplished manually. The rotary cam continues to rotate through 360° to its starting position.

When the door starts its movement toward its open position, a longitudinally extending rib on the side of the roller support plate moves beneath a second roller bearing secured to the vertical locking bar to hold the locking bar in its raised locking position until the door reaches its fully open position, whereupon the second roller bearing rolls off of the end of the rib and the cam plate is moved transversely by its spring bias to lower the vertical locking bar to its locking position relative to the door. Such movement is permitted by the rotary cam which, as stated, has been rotated through 360° to return to its original locking position. In such locking position, the second roller bearing on the locking bar drops to a position adjacent to the end of the longitudinally extending rib on the roller support plate to provide a top lock for the door.

An outstanding feature of the construction of this invention is that the aforedescribed unlocking and locking operations are identically accomplished by a single design for either a right hand opening door or a left hand opening door. This results in significant economies in the construction of doors for cells, hospitals, factories, office buildings and the like where reliable remotely controlled locking and unlocking of a door is desired.

If a backup unlocking system is desired for the second modification of this invention, this may be readily provided by an opening in the housing enclosing the entire upper portion of the door and its electrically operated locking system. Such opening is normally closed by a key operated closure plug. A forwardly projecting abutment is secured to the ca plate adjacent the aforementioned opening, and a rigid rod may be inserted through such opening and engaged with the bar to laterally shift the locking plate to its unlocking position. Again the simplicity of the backup door locking system of this invention over the complex designs of the prior art is readily apparent to those skilled in the art.

Further objects and advantages of cell door operating and locking systems embodying this invention will be readily apparent to those skilled in the art from the following detailed description of two preferred embodiments of the invention, taken in conjunction with the annexed sheets of drawings.

DETAILED DESCRIPTION OF THE PREFERRED EMBODIMENTS

Figure 1:
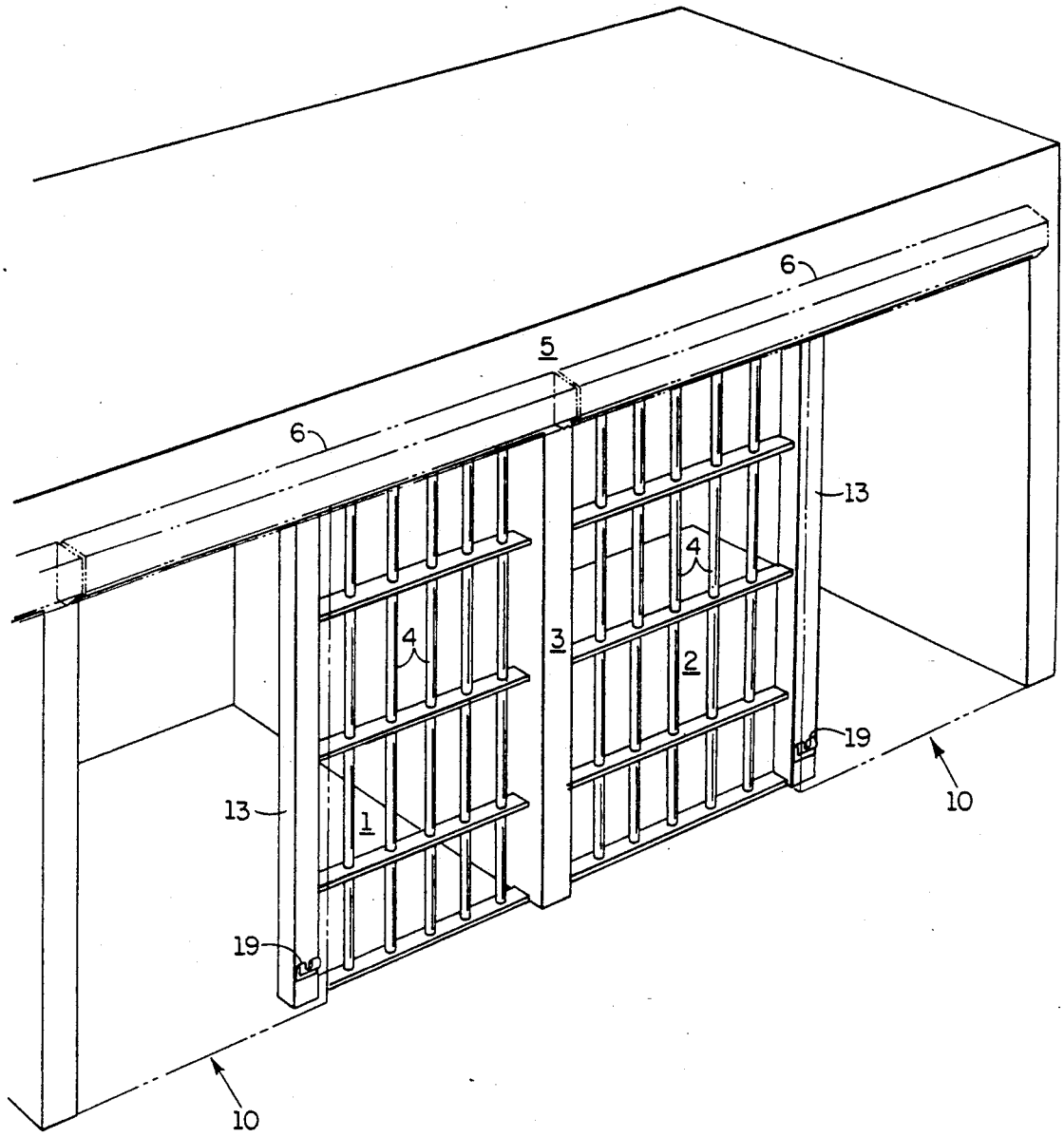
FIG. 1 is a schematic perspective view of a cell door installation embodying this invention for two adjacent cells.

Referring to FIG. 1, there is schematically shown a block of two adjoining cells 1 and 2 having a common wall 3. Cell 1 has a left hand entryway closable by a door 10 while cell 2 has a right hand entryway closable by an identical door 10. Occupant restraining walls 4 close the right hand side of cell 1 and the left hand side of cell 2. Restraining walls 4 respectively extend from a central vertical column 13 in each cell opening to the common wall 3. The top of each cell entryway is defined by a vertical wall 5 to which is attached a steel transom plate 15 (FIG. 2) by suitable bolts. All of the operating mechanism for the respective cell door 10 is mounted on transom plate 15 and enclosed by a steel housing 6 which is only shown by dot-dash lines. It should be understood that not only are the right hand and left hand opening cell doors 10 identical, but also the operating mechanisms, which will, however, be described for only the left hand opening door 10 used for cell 2.

Figure 2:
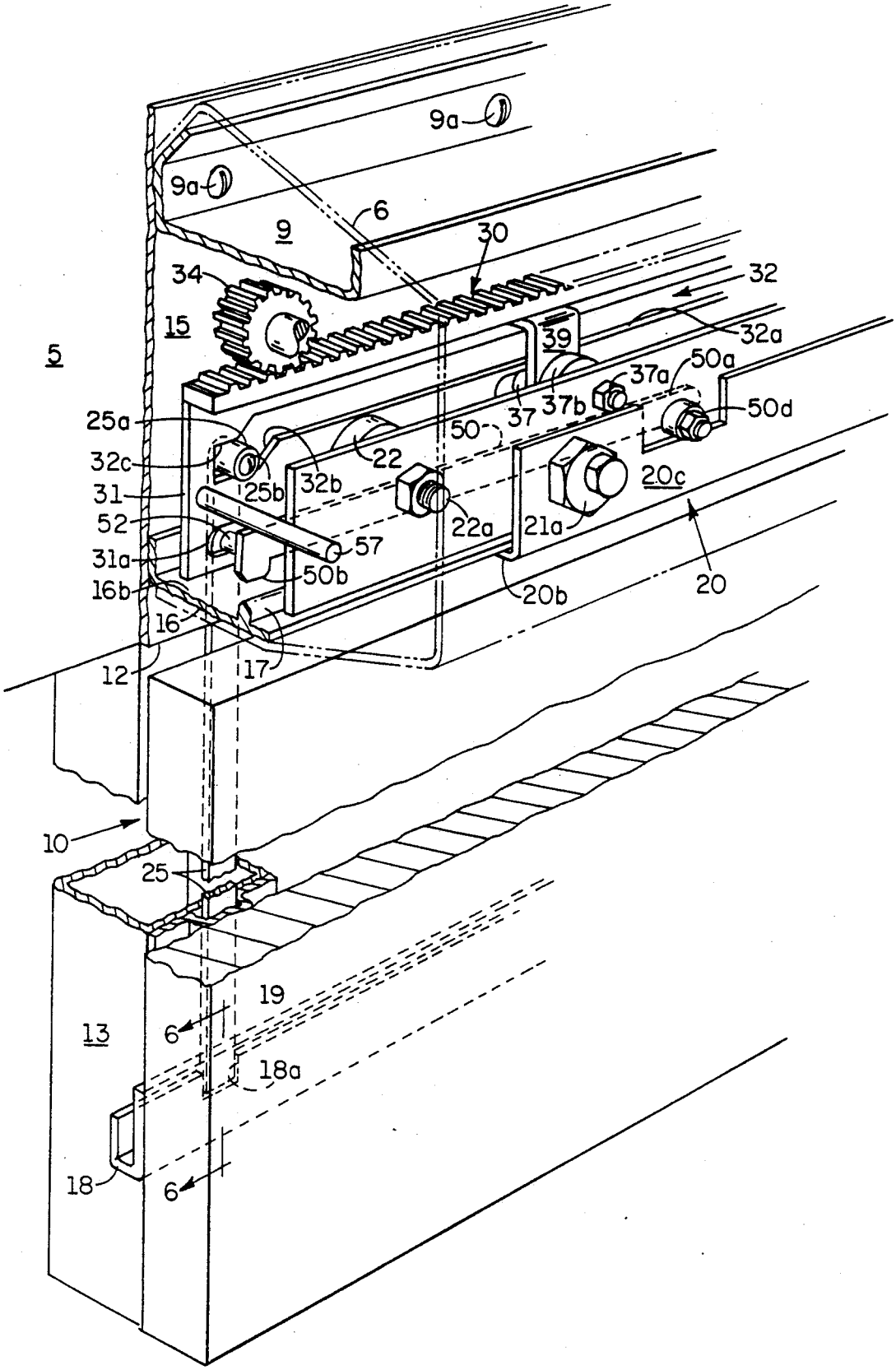
FIG. 2 is a schematic perspective view of the left hand side of a cell door and its operating mechanism embodying this invention, with parts omitted for clarity.

Referring now to FIG. 2, it will be noted that an L-shaped bracket 16 is welded or otherwise rigidly secured by bolts to the lower end of the transom plate 15 and defines a horizontal flange 16*b* which provides a mounting for a horizontally extending, upstanding track 17. An inverted channel-shaped bracket 9 is also secured by bolts 9*a* to the upper portion of transom plate 15 and provides a mounting for the steel housing 6.

An elongated, generally Z-shaped door hanger 20 is rigidly secured along the upper end of the door 10. Door 10 will be understood to have internal metallic frame elements, both horizontal and vertical (not shown) and metal sheathing on both the inner and outer faces of the door. If desired, an observation window (not shown) may be provided in the door 10.

The Z-shaped door hanger 20 has a vertical portion 20*a* secured to the rear face of the upper horizontal frame of door 10, and a forwardly projecting horizontal portion 20*b* which underlies the upper frame bracket 16*b* and terminates in an upwardly extending flange 20*c* on which is adjustably mounted a roller mounting plate 21 by eccentric bolts 21*a*. A plurality of rollers 22 are mounted on plate 21 in laterally spaced relationship across the top of the door 10. Rollers 22 cooperate with the track 17 provided on the horizontal flange 16*b* and thus permit the door 10 to be readily rolled from one side of the cell door opening to the other side.

Figure 5:
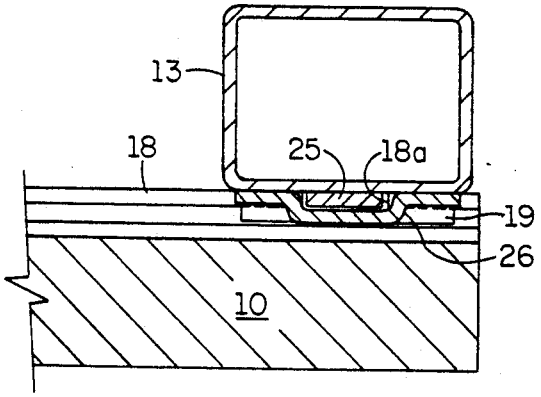
FIG. 5 is a partial sectional view taken on the plane 5—5 of FIG. 4.

It should be noted that in any position, the door 10 overlaps the front face of the center column 13, as clearly shown in FIG. 2. A locking bar 25 is mounted on the front face of column 13 for limited vertical movement. The locking bar 25 is secured by a recessed plate 26 (FIG. 5) which is welded or otherwise rigidly secured to the front face of center column 13. The locking bar 25 extends from a position adjacent the bottom of door 10 to a position above the track flange 16*b* of the bracket 16.

Figure 6:
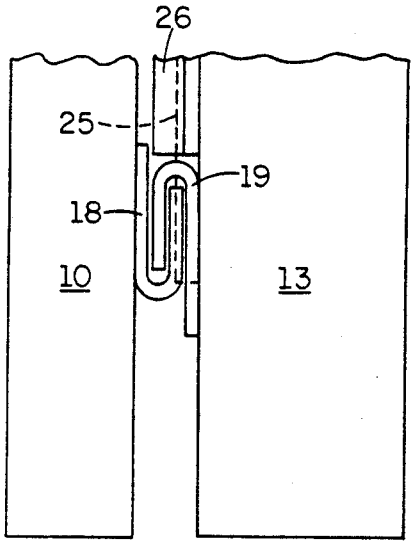
FIG. 6 is a partial sectional view taken on the plane 6—6 of FIG. 2.
Figure 7:
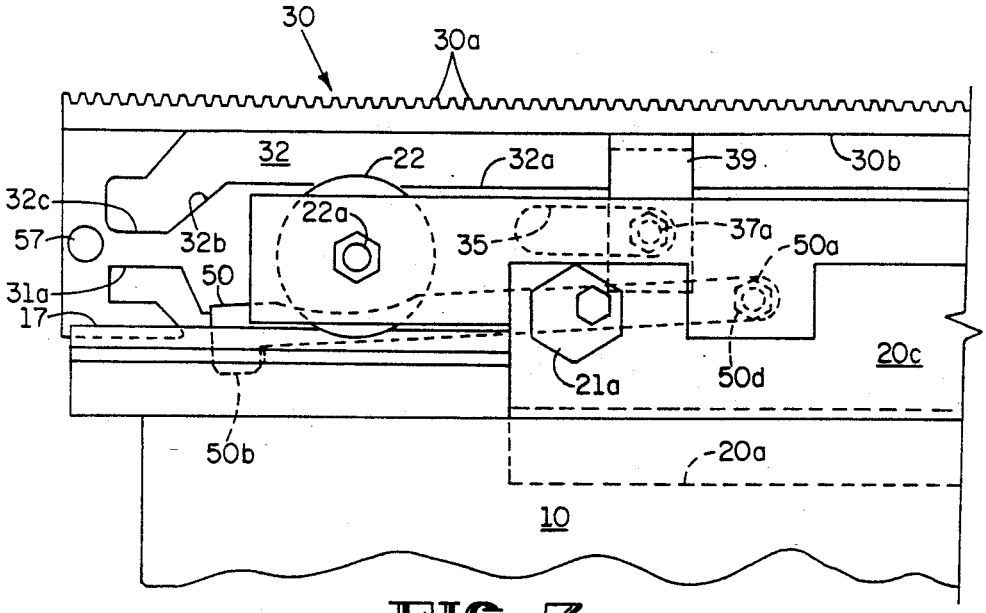
FIG. 7 is a front elevational view of the left hand upper latch mechanism.

The cell door 10 is provided with a bottom lock frame 18 extending across the bottom region of the door and rigidly secured to a frame member of the door. Lock frame 18 is of U-shaped configuration and is secured to door 10 with its channel facing upwardly. A downwardly opening U-shaped guide 19 (FIG. 6) is secured to the front face of center column 13 and engages in the upwardly opening channel of U-shaped lock frame 18 to restrain the bottom of cell door 10 from transverse movement.

The lock frame 18 is provided at each end with upwardly opening locking notches 18*a* to respectively receive the bottom end of locking bar 25 in locking relation when the cell door 10 is in either its closed position shown in FIG. 1, or its open position (FIG. 2) wherein the right hand locking notch 18*a* is engaged by the locking bar 25.

The locking bar 25 is raised or lowered by a cam slot or track 32 provided on a rack support plate 31 which has a total length greater than the cell door 10 and is slidably mounted on the horizontal flange 16*b*. Cam track 32 is engaged by a roller 25*a* which is journalled on a bolt 25*b* traversing the upper end of locking bar 25. The cam track 32 has an extended medial portion 32*a* which holds roller 25*a* in an elevated position, hence holding locking bar 25 out of both notches 18*a*. At the ends of the cam track 32, the track slopes downwardly as indicated at 32*b* and then extends horizontally a short distance as indicated at 32*c*. When the roller 25*a* enters either of these downwardly sloped portions, the locking bar 25 is urged downwardly into engagement with either the right hand or left hand locking notch 18*a*, depending upon whether door 10 is in its open or closed position.

Figure 8:
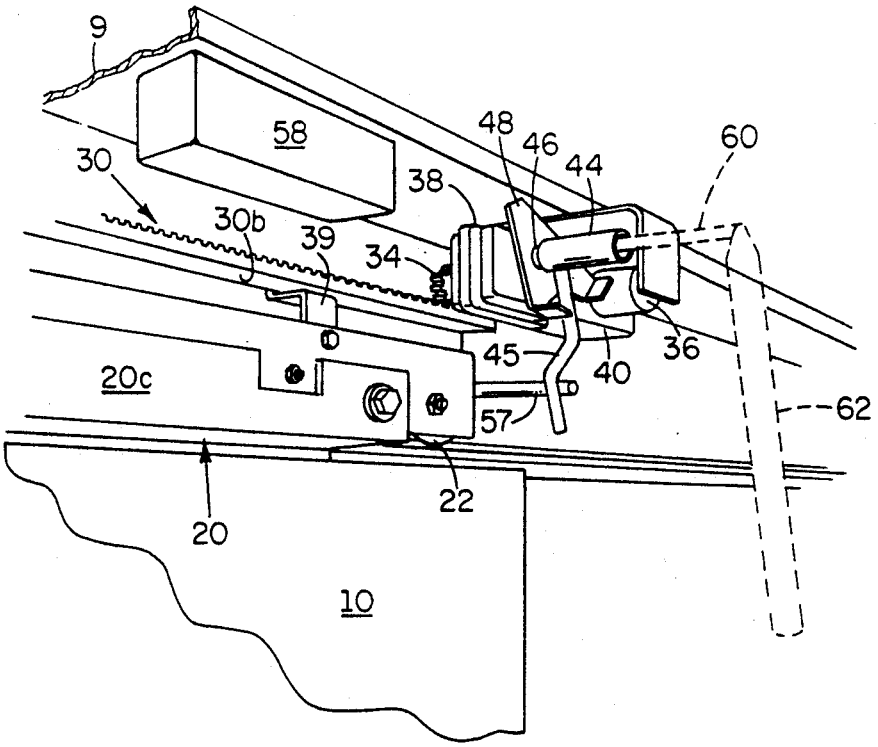
FIG. 8 is a schematic perspective view of the lever key backup operating mechanism for opening the cell door in the event of an electrical failure.
Figure 9:
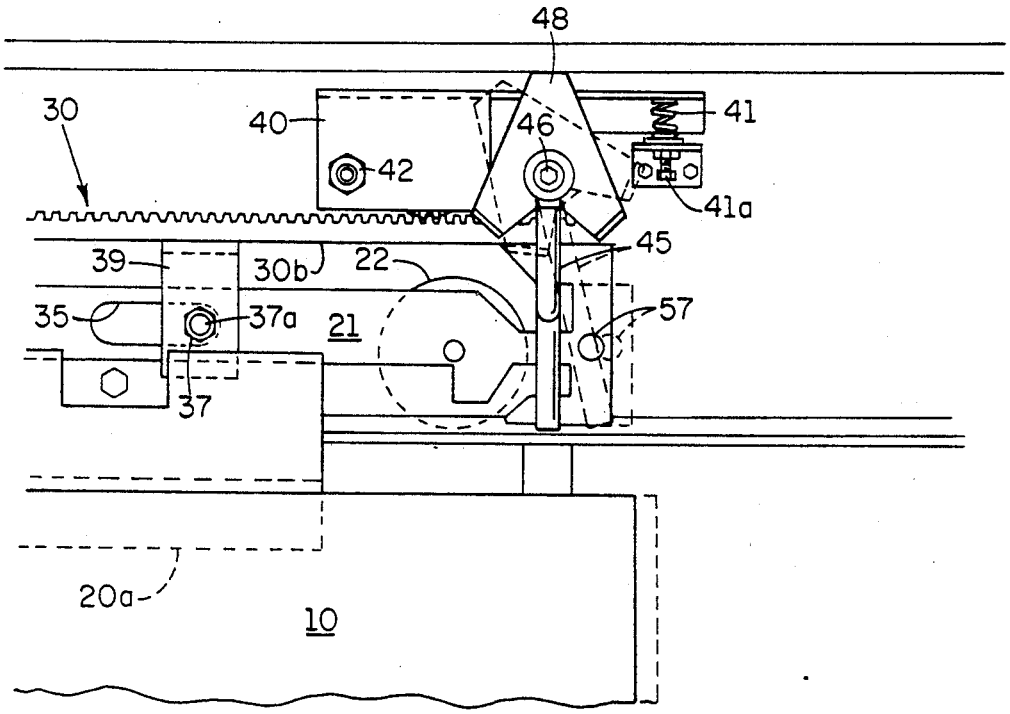
FIG. 9 is a front elevational view of the lever backup operating mechanism, showing the two positions of such mechanism.

The rack 30 has a plurality of teeth 30*a* provided on its upper surface which are drivingly engaged by a pinion 34. Pinion 34 is in turn driven by a reversible DC motor 36 through a gear reduction unit 38 (FIG. 8). Pinion 34, the gear reduction unit 38 and the DC motor 36 all secured to a support frame 40 which is pivotally mounted to the transom plate 15 by a pivot bolt 42 (FIG. 9). An adjustable compression spring 41 is preferably provided to urge the support bracket 40 to a position where the pinion 34 will not be engaged with the teeth 30*a* of the rack 30. A cam 48 (to be later described) normally holds the pinion 34 in firm engagement with the rack teeth 32 by engagement with the underside of bracket 9.

Figure 3:
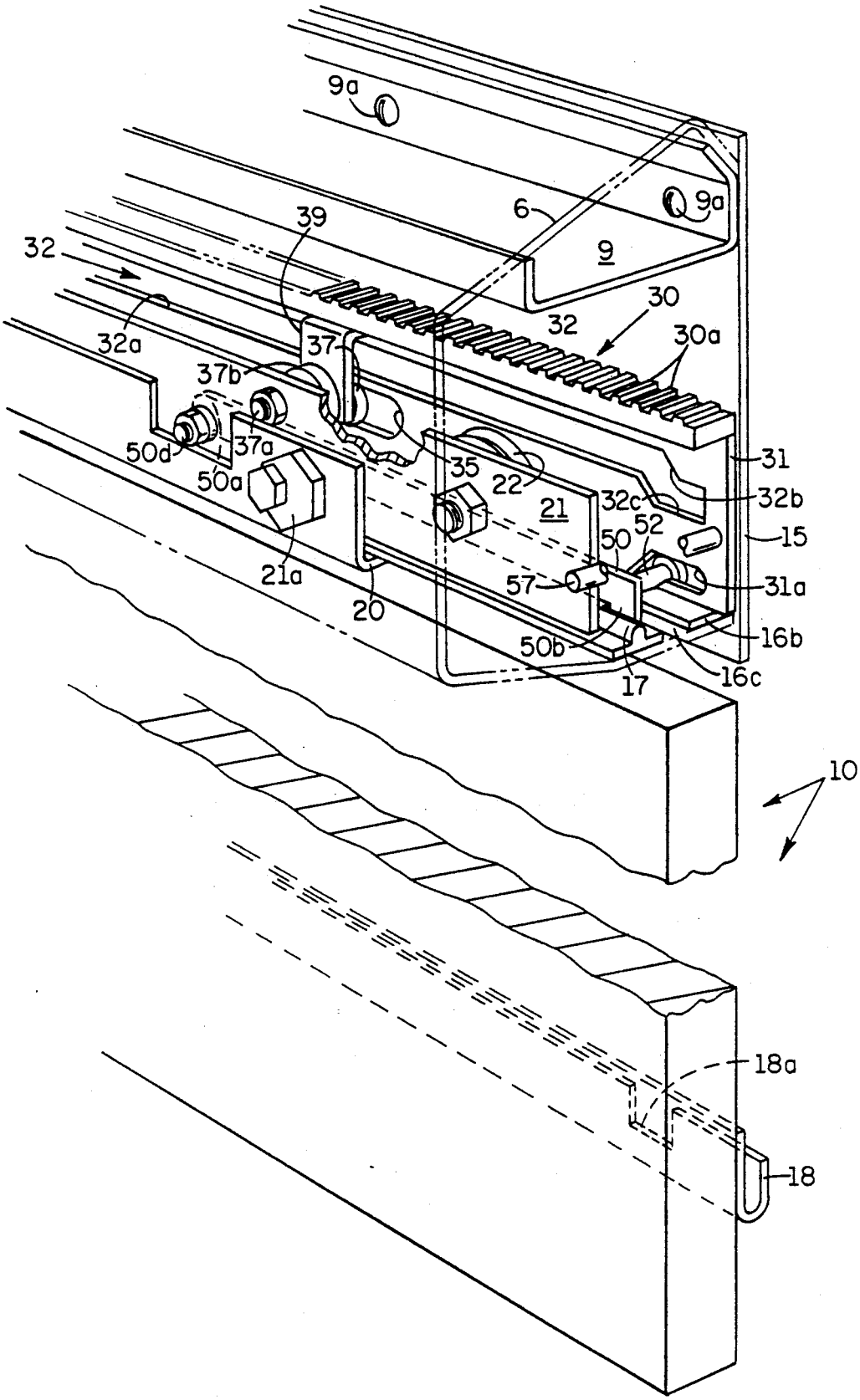
FIG. 3 is a schematic perspective view of the right hand side of a cell door and its operating mechanism embodying this invention with parts omitted for clarity.

The rack 30 is provided with a lost motion connection to the cell door 10. Such lost motion connection may be conveniently provided by a pair of rollers 37 mounted on bolts 37*a* (FIG. 3) which are secured to roller mounting plate 21. Rollers 37 respectively engage limited length slots 35 provided in the rack support plate 31 (FIG. 3). Bolts 37*a* also provide a mounting for spacers 37*b* and rack guide brackets 39 which slidably support the underside 30*b* of the rack 30.

From the description thus far, it will be apparent that whenever the DC motor 34 is energized in the proper direction to either open or close the door 10, the initial movement of the rack 30 is independent of the door 10 due to the lost motion connection. This permits the cam track 32 to lift the locking bar 25 out of engagement with the right hand or the left hand locking notch 16*a*, as the case may be, and free the cell door 10 for movement when the lost motion rollers 37 reach the end of their cooperating slots 35. The door 10 is then moved with the rack 30 to its open or closed position, whereupon the inclined cam portion 32*b* at the other end of the cam track 32 forces the locking rod 25 into engagement with the other locking notch 18*a* and anchors the cell door 10 in its new position, whether that position is open or closed.

It is therefore obvious that the door 10 may be installed in either a right hand or a left hand opening, that the design of the door is entirely symmetrical and no changes are required to accommodate the selected right hand or left hand opening position.

A pair of upper latches 50 are provided on the opposite ends of the vertical flange 20*c* of the Z-shaped door hanger bracket 20. The upper latches 50 (FIGS. 2 and 3) are generally L-shaped with the long end 50*a* of the L being pivotally secured to the roller mounting plate 21 by bolt 50*d* and the short end 50*b* of the L functioning as a latch to engage in one of three notches 16*c* provided in the center and each of the opposite ends of the fixed horizontal flange 16. The positions of the latches 50 are each controlled through the cooperation of a horizontally projecting, headed pin 52 provided on each latch 50 with relatively short cam tracks 31*a* provided in opposite ends of the vertical rack support 31. When the rack 30 is moved in either direction, the cam tracks 31*a* concurrently elevate the latches 50 out of engagement with the notches 16*c* during the lost motion movement of the rack, thus freeing the latches 50 from the latching notches 16*c* so that the cell door 10 is free to move.

Again, the latches 50 function irrespective of whether the cell door operates as a right hand or a left hand opening door.

To prevent burn out of the DC motor in the event that the cell door is accidentally or purposely jammed during its opening or closing motion, the method of this invention contemplates a control circuit for each DC motor which, when a predetermined increase in current flow to a particular motor occurs, a sensor is actuated to operate a relay and disconnect such motor from the 24 volt supply conduit. The same relay functions to initiate the operation of a timing relay which at selected intervals, say from three to five seconds, applies the full 24 volt operating energy to the stalled DC motor for only a few milliseconds If the same rise in the current above that normally associated with the operation of the cell door occurs, the energization is interrupted for another delay period and then again applied for a few milliseconds. Thus, the blocked condition of the cell door is continuously tested by the electrical circuit, and as soon as the blockage is removed, the DC motor 34 will be continuously energized to produce the desired opening or closing movement of the cell door.

Figure 10:
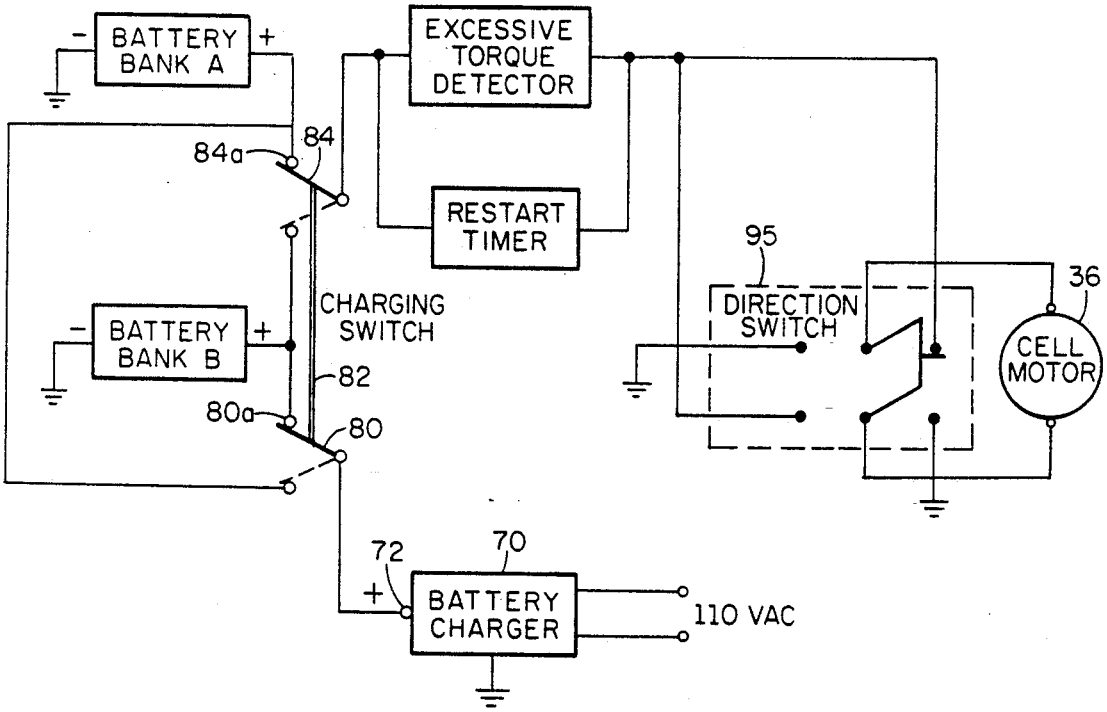
FIG. 10 is a schematic diagram of the energization and battery charging circuit for an individual DC cell door motor.

The circuitry for carrying out the aforedescribed method of energization of the reversible DC motors 36 is shown in FIG. 10. Many of the electrical circuit elements can be housed in a control box 58 (FIG. 8) suitably secured to bracket 9 above the rack 30. The entire operating mechanism is enclosed within the generally U-shaped steel cover 6 which is conventionally fastened to flange 16*a* and bracket 9 by bolts requiring a special tool to unfasten.

Referring to the schematic circuit diagram of FIG. 10, it will be noted that preferably at least two battery banks A and B are provided for operating the cell motors 36. For simplicity, only a single cell motor will be shown and a plurality of conventional details, such as lights indicating when a cell door is in its open or closed position, will not be included. A conventional battery charger 70 operable from a 110 volt AC source may be employed and the DC output terminal 72 of the charger 70 is connected to one pole of a two position switch 80. Switch 80 is mechanically coupled by a link 82 to a similar switch 84 and the switches 80 and 84 are thus operated concurrently. The output of battery bank A is connected to terminal 84*a* of switch 84 while the output of battery bank B is connected to terminal 80*a* of switch 80. In the solid line positions of the switches 80 and 84, the battery bank B is connected to the output terminal 72 of battery charger 70. Alternatively, a single battery bank and a well known floating charger can be used for small installations.

The positive or output terminal of battery bank A is connected through switch 84 to an excessive torque detector 90 and a restart timer 92. Both of these units are connected in series with the cell motor 36 through a conventional polarity reversing switch 95. When the cell motor 36 is operating normally and not generating any excessive torque, the restart timer 92 is inoperative. However, when an excessive torque occurs, such as that produced by blocking the cell door, the current drawn by the cell motor 36 sharply increases and this increase in current is sensed by the excessive torque detector 90 and an appropriate relay (not shown) is opened to disconnect the cell motor 36 from the source of DC energy. The restart timer is concurrently activated and such timer functions to periodically, generally at intervals of three to five seconds, apply a normal voltage to the cell motor 36 to determine whether the motor can restart without generating excessive torque. The time period for such energization is on the order of five to ten milliseconds so that there is no danger that the cell motor 36 will be overheated by the successive attempts to restart the motor. When the motor is restarted, without excessive torque, the excessive torque detector restores the normal direct connection to the power source and de-energizes the restart timer. All of these elements are conventional and well known in the art, hence further description is deemed unnecessary. When the switches 80 and 84 are concurrently moved to their dotted line positions shown in FIG. 10, the battery bank B is then disconnected from the battery charger 70 and connected through switch 84 to the excessive torque detector 90 and the restart timer 92 to supply energizing current for the cell motor 34. Concurrently, the battery bank A is connected to the output terminal 72 of the battery charger through the switch 80. It is thus assured that one bank of batteries is always being charged while the other is being employed to operate the cell motors. Thus, the possibility of failure of the system due to discharged batteries becomes minimal.

For simplicity of illustration, switches 80, 84 and 95 have been shown as mechanically operated, however, conventional electronic units would preferably be utilized.

From the foregoing description, it will be readily apparent that the method and apparatus of this invention provides a greatly simplified and much more economical apparatus and method for operating cell doors. The utilization of DC current supplied by batteries substantially eliminates the need for any mechanical backup which heretofore was a necessity since the opening of the cell doors was normally accomplished by utilization of utility supplied AC current.

Figure 4:
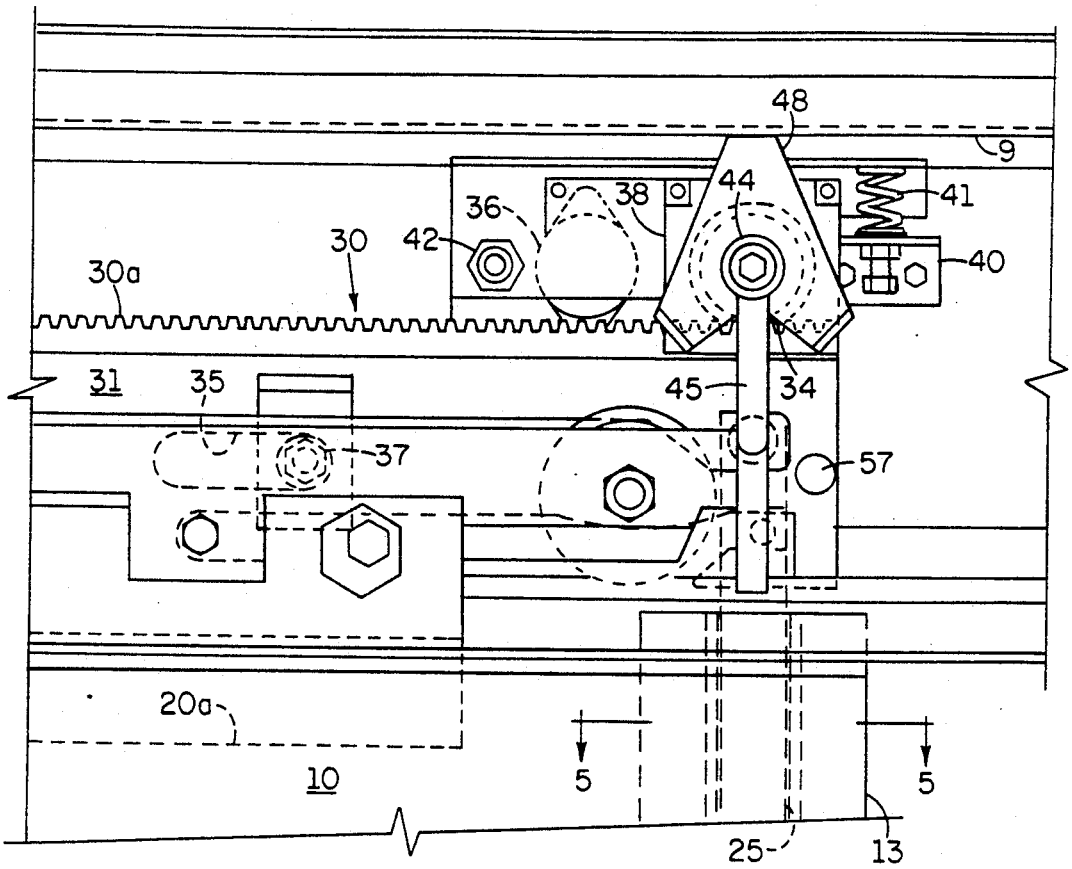
FIG. 4 is a front elevational view of the rack and pinion operating mechanism for the cell door of FIG. 1.

A conventional lever key mechanism for individually operating any cell door can be readily incorporated. As shown in FIGS. 4, 8 and 9, the key operated mechanism comprises a key shaft 60 having an elongated operating handle 62. The key shaft 60 is insertable within a tube 44 which in turn conceals the end of a shaft 46 mounted on the motor support bracket 40. The end face (not shown) of key shaft 60 is shaped to conform to a non-symmetrical end face of shaft 46. Turning the shaft 46 by key shaft 60 in either direction effects the rotation of a cam 48 which releases from engagement with the underside of bracket 9. This permits motor support frame 40 to be pivoted upwardly by spring 41 to elevate the pinion 34 from engagement with the rack 30. Further rotation of the shaft 46 brings a projecting arm 45 secured to the tube 44 into engagement with one of two horizontal rods 57 secured to opposite ends of the front side of the rack supporting bracket 31, thus providing a lost motion connection to the rack 30. The rack 30 is moved through its lost motion distance to effect the unlocking of the vertical locking bar 25 and the end latches 50, thus permitting the cell door 10 to be manually shifted in the selected direction. The required movement of the arm 45 effect the unlocking is indicated by the dotted lines in FIG. 9.

Referring now to FIGS. 11–15, there is shown a modified locking mechanism embodying this invention which differs primarily from the previously described modification in that the cell door is not moved by a motor between its open and closed positions. As in the previous modification, cell door 10 is completely symmetrical and may be mounted to open either the right or left of a central post 13 mounted in the passageway to the cell, as illustrated in FIG. 1. Identical numerals in the modification of FIGS. 11–14 refer to identical parts previously described in connection with the modification of FIGS. 1 to 10. Thus the cell door 10 is supported for horizontal sliding movement by a plurality of rollers 22 which are respectively mounted in horizontally spaced relationship on a roller mounting plate 21. The roller mounting plate 21 is in turn supported by the upstanding vertical flange **20*c* of the generally Z-shaped bracket 20 which is secured to the upper portions of the door 10**.

As previously described, the door supporting rollers 22 engage a horizontally extending, upstanding track 17 provided on the horizontal flange portion **16*b* of the L-shaped bracket 16. As in the previous modification, a locking bar 25 is supported for limited vertical movement on the front face of the center column 13 and the bottom end of the locking bar 25 engages one of two notches 18*a* respectively provided on opposite lateral sides of a U-shaped bracket 18 secured to the rear face of the door 10, as shown in FIG. 2. Thus, the door 10 may be locked in either its open position, shown in FIG. 11, or its closed position shown in FIG. 13 by the engagement of the lower end of locking bar 25 with the respective notch 18*a* corresponding to the closed or open position of door 10**, as previously described.

Figure 15:
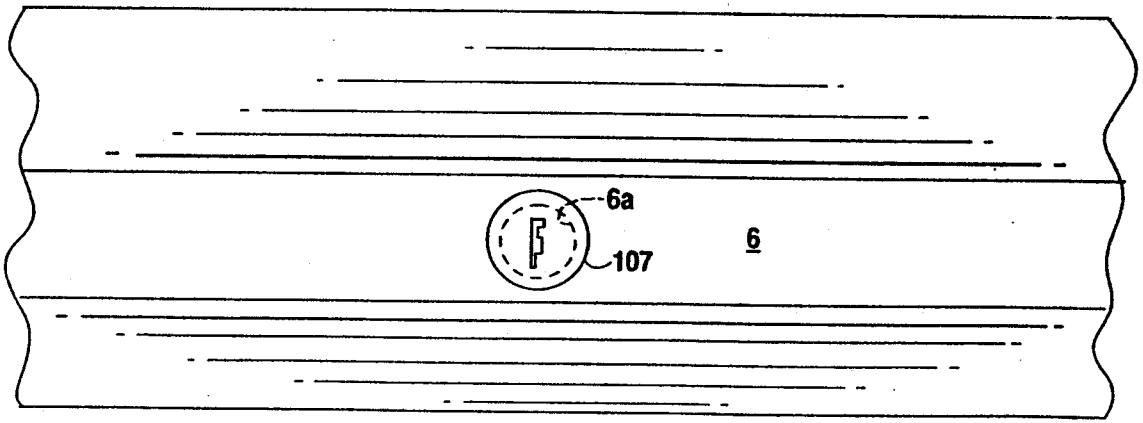
FIG. 15 is a partial front elevational view of the housing enclosing the door locking mechanism.

The top portion of locking bar 25 extends upwardly through a suitable notch or slot (not shown) formed in the track plate **16*b* and the enclosing housing 6, which is shown in FIGS. 2, 3 and 15. The remainder of the locking mechanism differs substantially from the previously described modification and these differing parts are indicated by a series of three figure numerals beginning with 100**.

Thus, a camming plate 100 is mounted on the transom plate 15 by a pair of outwardly projecting bolts 101 and 102. These bolts respectively pass through slots **100*a* and 100*b* formed in the cam plate 100. Spacer washers 101*a* and 102*a* (FIG. 14) are respectively mounted on the bolts 101 and 102 to space the camming plate 100 forwardly relative to the transom plate 15 so as to provide sufficient room to accommodate the upper portion 25*a* of the locking bar 25**.

Adjacent the top end **25*a* of the locking bar 25 a cam roller 25*b* is rotatably mounted in forwardly projecting relationship. Cam roller 25*b* engages a generally S-shaped slot 104 formed in the cam plate 100. Cam slot 104 has a lower horizontal portion 104*a* corresponding to the locking position of the locking bar 25 and an upper horizontal portion 104*c* corresponding to the unlocked position of the locking bar 25. Intermediate these cam positions is an inclined portion 104*b* which effects the transition of the locking bar 25 between its locked and unlocking positions by horizontal movements of the cam plate 100. The extent of horizontal movement of the cam plate 100 is determined by the length of the slots 100*a* and 100*b*. In distinct contrast to the prior modification, the horizontal movements of the cam plate 100 are entirely independent of the movements of the door 10**.

The horizontal movements of the cam plate 100 are controlled by a rotary cam 110 which is eccentrically mounted on the output shaft 112 of a gear reduction unit 118 which is driven by a DC motor 116. Motor 116 and the gear reduction unit are mounted on a U-shaped bracket 114 which is fixedly mounted to the transom plate 15 by bolts 111 and 112. A roller bearing **100*c* is mounted on the right hand end of the cam plate 100 and cam plate 100 is biased to engage roller bearing 100*c* with the periphery of the eccentric cam 110 by a tension spring 113. Thus the rotation of eccentric cam 110 through 180° from its position shown in FIG. 11 to its position shown in FIG. 12 will effect a horizontal shifting of the cam plate 100 sufficient to move the roller 25*b* on the locking bar 25 through the cam slot 104 to its unlocking position where the locking bar is raised out of engagement with the particular recess 18*a*** with which its bottom end was engaged.

Figure 13:
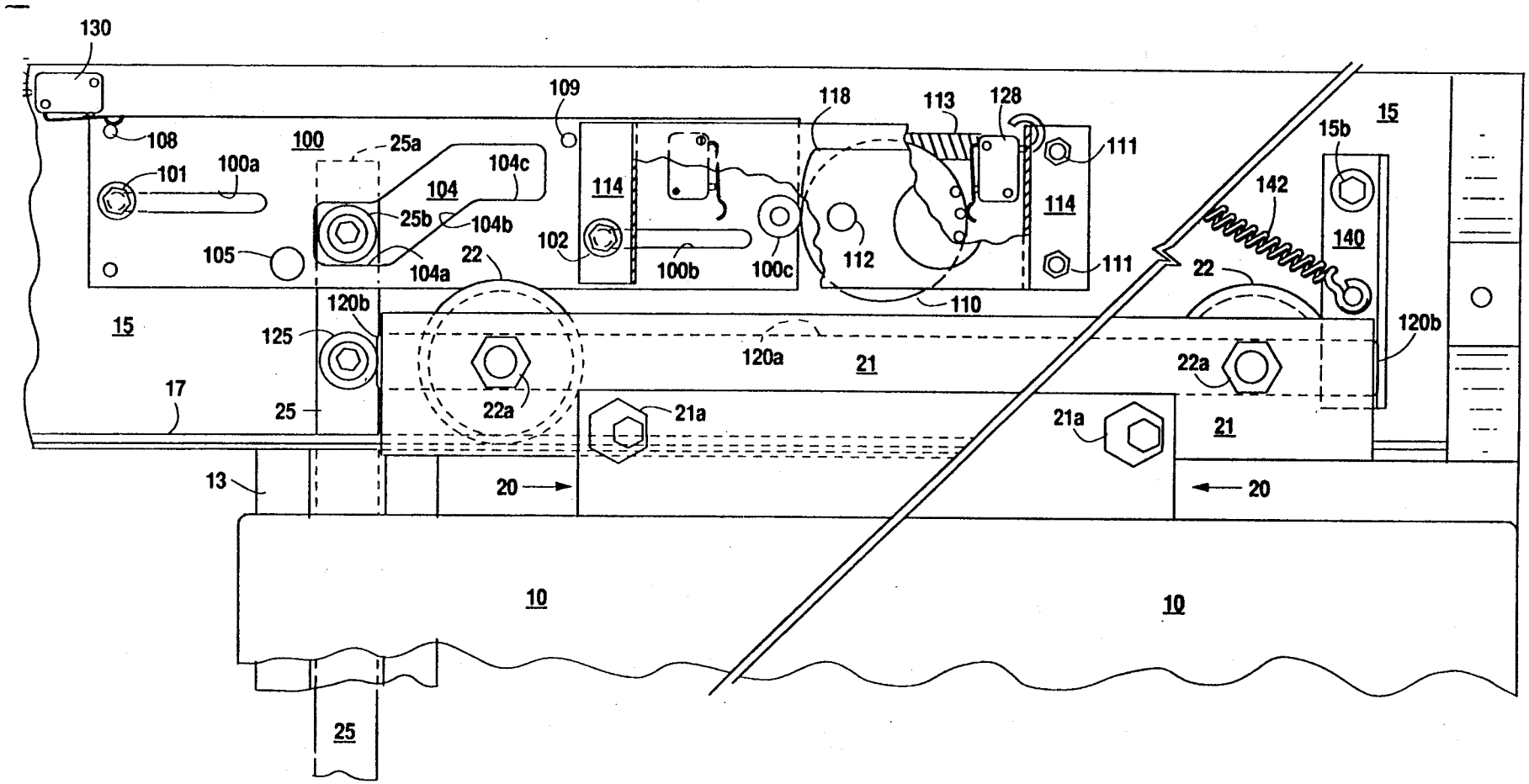
FIG. 13 is a reduced scale view similar to FIG. 12 but showing the door in a position opposite to the position shown in FIG. 11.
Figure 14:
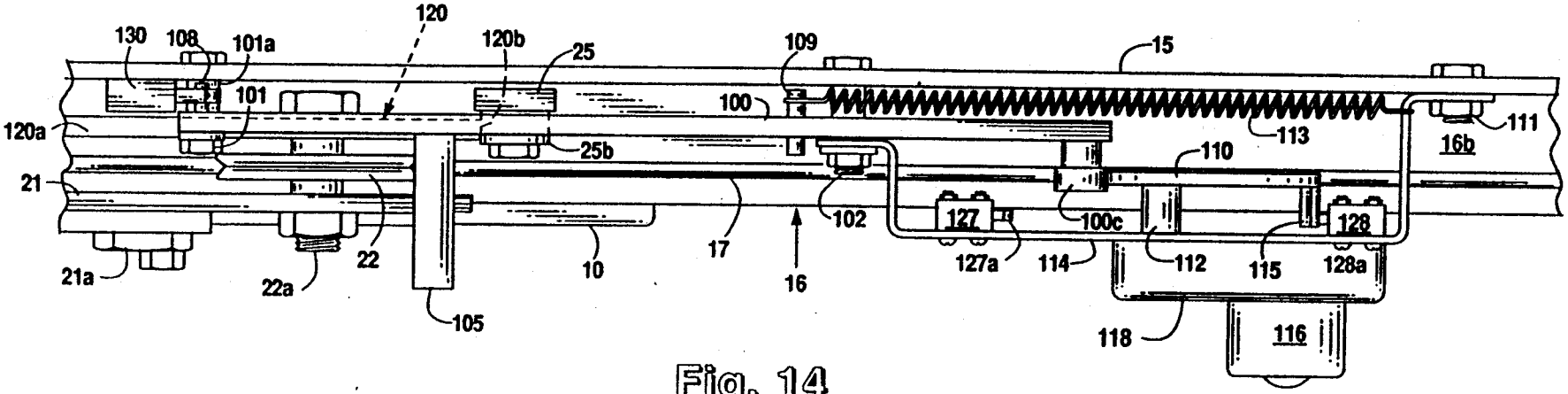
FIG. 14 is a top view of FIG. 11.

As the locking bar 25 moves upwardly, a second roller bearing 125 mounted on the front face of locking bar 25 moves upwardly to engage a horizontal lock open retaining surface **120*a* formed on a rib 120 which extends across the full width of the roller mounting plate 21. Assuming that the door 10 is being moved to the right as viewed in FIGS. 11 and 12 to either a closed or open position with respect to the door frame in which it is mounted, it will be apparent that the lock open retaining surface 120***a* holds the locking bar 25 in its elevated position until the movement of door 10 to the right is completed (as shown in FIG. 13) and the roller 125 can move downwardly adjacent the end surface of the lock open retaining rib 120. It should be noted in FIG. 11 that the roller 125 engages the vertical end surface 120*b* of the lock open retaining bar 120 and provides an additional lock at the top of the door preventing movement of the door to the right. However, when the movement of the door to the right is completed as shown in FIG. 13, the locking bar 25 is free to move downwardly into a locking position provided that the rotary cam 110 is in the proper angular position to permit such movement.

Figure 11:
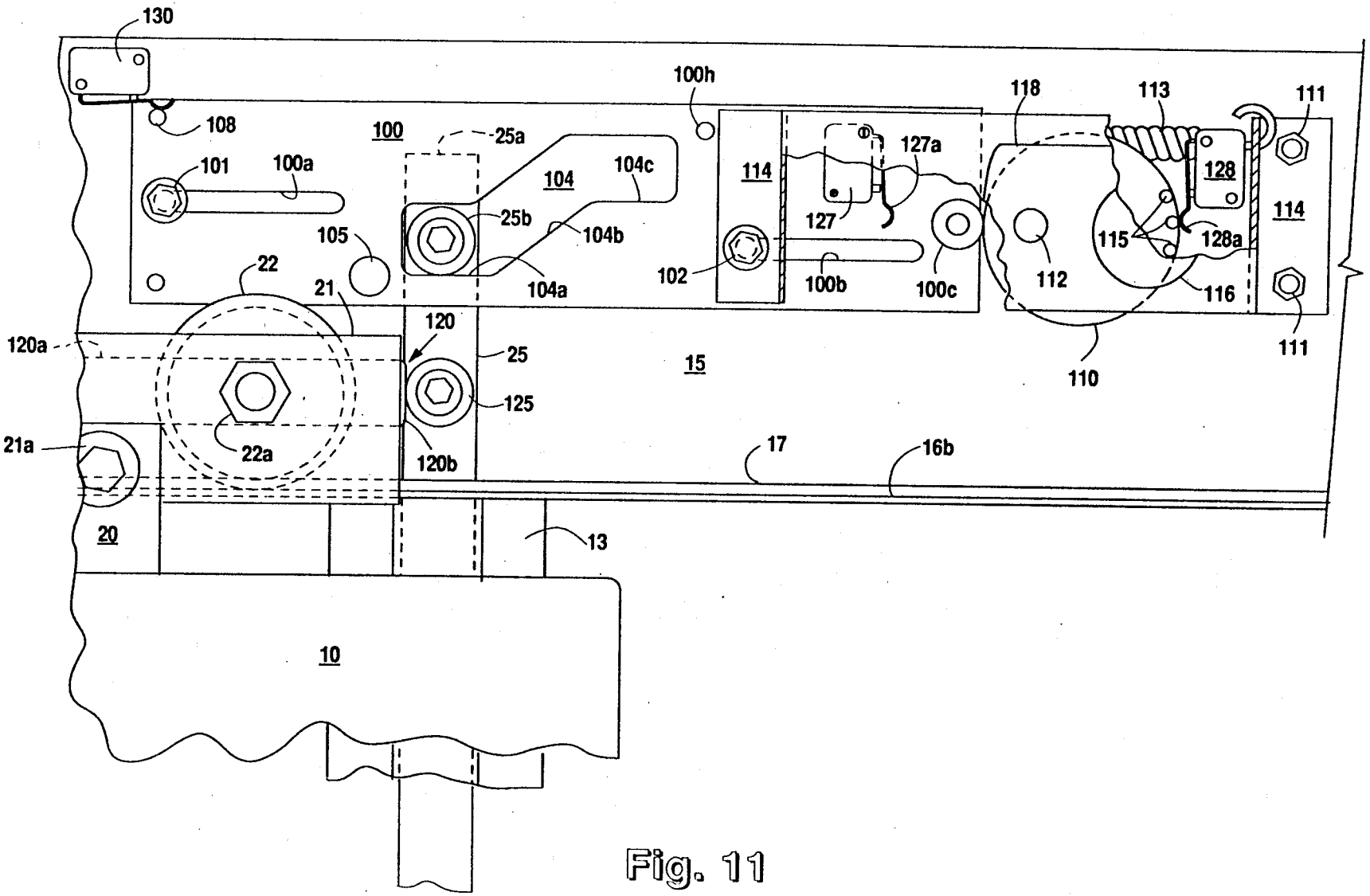
FIG. 11 is a front elevational view with parts broken away for clarity, of a modified door locking system, with the locking mechanism in its locked position.
Figure 12:
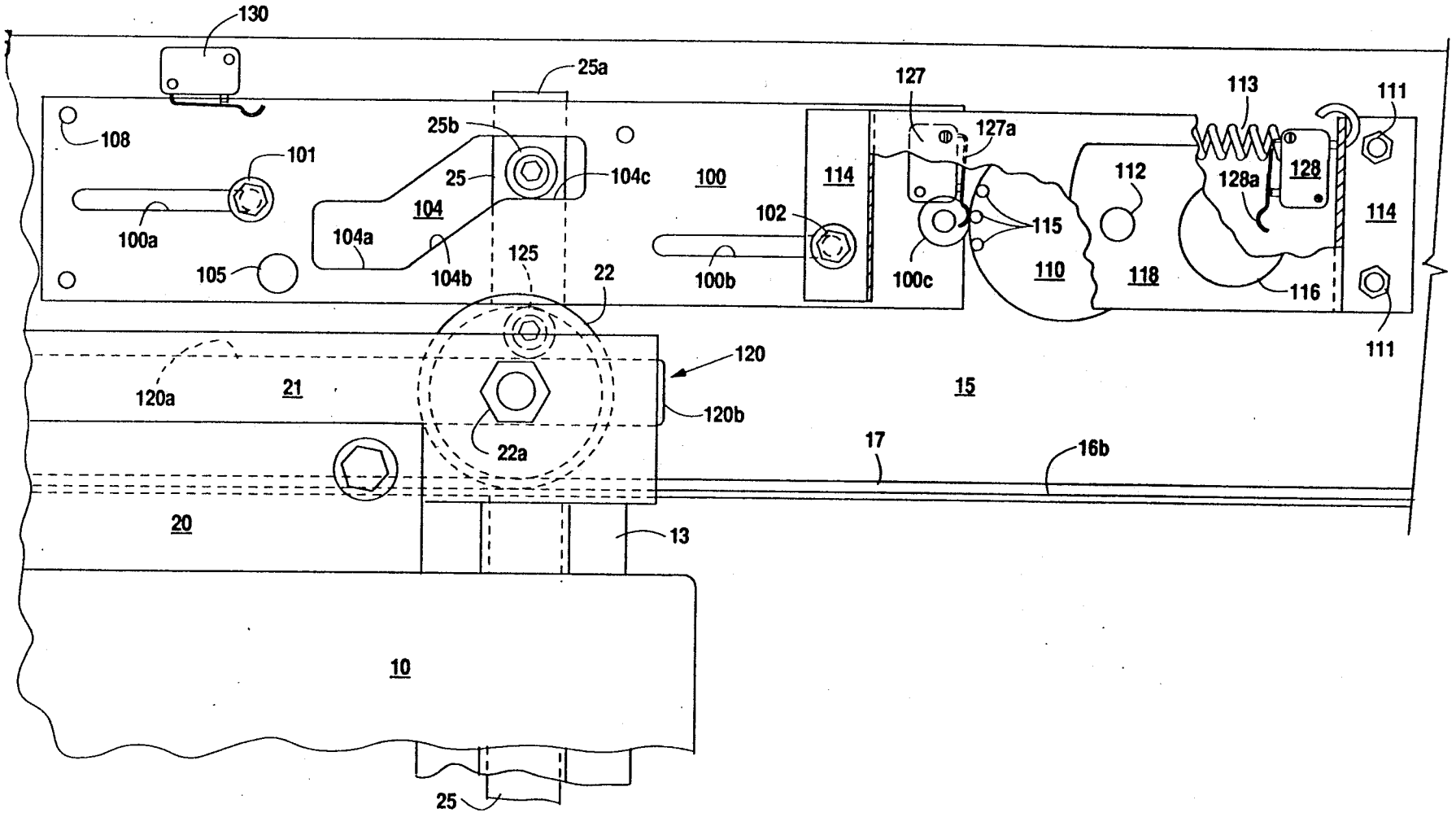
FIG. 12 is a view similar to FIG. 11 but showing the locking mechanism in its unlocked position.

Conventional electrical circuitry is provided for the DC motor 116 that drives the rotary cam 110 to selectively rotate the rotary cam 110 by either 180° or 360°. If driven through only 180°, the camming plate 15 will shifted to the left to its open position and held there by the rotary cam 110. If the energization circuit for DC motor 116 provides a full 360° rotation of the rotary cam 110, then the camming plate 100 is returned under the bias of the spring 113 to its right hand locking position as shown in FIG. 11. To detect and control the angular position of the rotary cam 110, three peripherally adjacent switch actuating posts 115 are mounted on the periphery of the rotary cam 110 to consecutively engage either a contact actuating lever 127*a* of a switch 127, or an actuating lever 128*a* of a switch 128. Levers 127*a* and 128*a* are 180° apart. The electrical circuitry employed is entirely conventional and will not be further described.

Similarly, a door condition switch 130 is mounted on the transom plate 15 in position to be engaged by a horizontally projecting pin 108 mounted on the left hand top end of the cam plate 100. When the cam plate is in its locking position, as shown in FIG. 11, the switch 130 is energized to provide an appropriate signal on a control panel and/or a light provided adjacent the location of the door 10.

As in the previously described modification of FIGS. 1–10, the DC motor 116 is energized from a bank of batteries that are continuously maintained in a fully charged condition. Since the motor 116 only has to move the cam plate 100 a slight horizontal distance, the energy requirements of the battery bank are minimal.

The motor 116 is energized by the closing of a switch on a remotely located control panel, or by a key operated switch located adjacent the door frame, as is conventional.

An additional feature of this invention is in the provision of a mechanism for automatically shifting the door slightly toward a desired position immediately upon releasing of the locking bar 25 from locking engagement with a respective one of the notches 18*a* and with the lock open maintaining rib 120. At both ends of the door travel, an arm 140 is pivotally mounted on the transom plate 15 by a bolt 15*b* so as to be engaged by the vertical edge of the roller mounting plate 21 as the door approaches that extreme lateral position. A tension spring 142 opposes pivotal movement of the lever 140 and thus imparts a modest spring bias to the door 10 to cause it to move toward its other lateral position upon movement of the locking bar 25 from its locked to its unlocked position. All movements of the door intermediate the slight movement produced by the springs 142 are accomplished manually. Nevertheless, when the door reaches either its fully open or its fully closed position, the locking bar 125 immediately assumes a locking position at its bottom end and at its top end, if the rotary cam 110 has completed 360° rotation. Thus, positive securement of the door is assured in either the fully opened or the fully closed position.

The modification of FIGS. 11–15 obviously has the same advantage of the previously described modification in that the door 10 and the locking and unlocking mechanism for such door is entirely symmetrical regardless of whether the door is to be moved to the right or left to a closed position with respect to a door frame.

In the unlikely event of a failure of the battery power source for the DC motor 116, an emergency backup operation of the locking mechanism of FIGS. 11–15 is conveniently provided. A large abutment post 105 is secured in forwardly projecting relationship to the cam plate 100. The generally U-shaped housing 6 (see FIGS. 2, 3 and 15) that encloses the entire locking mechanism is provided with an opening 6*a* adjacent to the abutment post 105. The opening 6*a* is normally closed by a key operated closure 107. When the key operated closure 107 is removed from opening 6*a*, a rod may be inserted through the opening 6*a* to engage the abutment post 105 and move the post, and hence the cam plate 100, to the left a sufficient distance to shift the locking bar 25 from its locked position to its unlocked position. Thus, a very simple and yet highly reliable backup system is provided.

Modifications of this invention will be readily apparent to those skilled in the art and it is intended that all such modifications be included within the scope of the appended claims.

What is claimed and desired to be secured by Letters Patent is:

1. A vertical door assembly mountable for linear manual movement in a door frame having opposed vertical walls spaced apart a distance less than twice the width of said door assembly, a vertical column centrally spaced relative to the vertical walls, an entry passageway extending from one side of said vertical column to a selected one of said vertical walls, and fixed restraining wall means extending from the other side of said central vertical column to said other vertical wall, comprising, in combination:

a vertical door having inner and outer faces;

means mounting said vertical door for horizontal movement in said door frame by minimal manual force between a closed position spanning the space between said central vertical column and said selected vertical wall and an open position spanning the space between said central vertical column and said other vertical wall;

an elongated locking bar mounted on the outer face of said central vertical column for limited vertical movement;

cam means disposed above the top of said vertical door and movable independent of said door for vertically shifting said locking bar between a lower locking position and an upper unlocked position;

means adjacent the bottom of said door and on the inner face thereof defining a pair of horizontally spaced locking notches respectively receiving the bottom end of said locking bar in said open and closed positions of said door, whereby the same door design may be employed to close an entry passage on either side of said central vertical column and is lockable in both its open and closed positions;

resilient means adjacent each said vertical wall respectively energized only by the final movements of said door into said open and closed positions, whereby the upward movement of said locking bar to disengage from one of said locking notches permits said resilient means to move said door a short distance from said open and closed positions;

said cam means for shifting said locking bar vertically further comprises:

a cam roller mounted on the upper end of said locking bar for rotation about a horizontal axis perpendicular to the path of vertical movement of said locking bar;

a cam plate slidably mounted adjacent said upper end of said locking bar for horizontal movement independent of the movement of said door;

said cam plate defining a slot engagable with said cam roller and configured to raise and lower said locking bar by horizontal sliding movements of said cam plate between a lock open and a lock closed position; and means including a motor driven rotary cam operatively connected to said cam plate to shift said cam plate to raise and lower said locking bar when said door is in either its said locked closed or locked open positions.

2. The apparatus of claim 1 wherein said motor driven rotary cam is driven by a DC motor, and further comprising a battery bank energizing said DC motor; and means for maintaining said battery bank in a substantially fully charged condition.

3. The apparatus of claim 1 further comprising a spring urging said cam plate into engagement with said rotary cam; and manually operable electrical control means for selectively energizing said motor to move said cam plate from its said lock open position to its said lock closed position and vice-versa.

4. The apparatus of claim 3 wherein said manually operable control means comprises a switch on a remotely located control panel for a plurality of doors.

5. The apparatus of claim 4 wherein said electrical control means further comprises a key operated switch located adjacent said door frame.

6. A vertical door assembly mountable for linear manual movement in a door frame having opposed vertical walls spaced apart a distance less than twice the width of said door assembly, a vertical column centrally spaced relative to the vertical walls, an entry passageway extending from one side of said vertical column to a selected one of said vertical walls, and fixed restraining wall means extending from the other side of said central vertical column to said other vertical wall, comprising, in combination:

a vertical door having inner and outer faces;

means mounting said vertical door for horizontal movement in said door frame by minimal manual force between a closed position spanning the space between said central vertical column and said selected vertical wall and an open position spanning the space between said central vertical column and said other vertical wall;

an elongated locking bar mounted on the outer face of said central vertical column for limited vertical movement;

cam means disposed above the top of said vertical door and movable independent of said door for vertically shifting said locking bar between a lower locking position and an upper unlocked position;

means adjacent the bottom of said door and on the inner face thereof defining a pair of horizontally spaced locking notches respectively receiving the bottom end of said locking bar in said open and closed positions of said door, whereby the same door design may be employed to close an entry passage on either side of said central vertical column and is lockable in both its open and closed positions;

a channel shaped steel enclosure for the top portions of said door and said cam means;

said steel enclosure having a small diameter access opening therein; and a forwardly projecting abutment bar secured to said cam means adjacent said opening, whereby a rod inserted through said opening can engage said abutment bar to shift said cam means to its unlocking position.

7. The apparatus of claim 6 further comprising a key openable closure for said access opening.

* * * * *